US005544841A

United States Patent [19]

Didier et al.

[11] Patent Number: 5,544,841

[45] Date of Patent: Aug. 13, 1996

[54] METHOD AND APPARATUS FOR REELING A TRAVELING WEB INTO A WOUND WEB ROLL

[75] Inventors: James J. Didier, Beloit, Wis.; Bruce L. Lindstrand; Ernest W. Wight, both of Roscoe, Ill.

[73] Assignee: Beloit Technologies, Inc., Wilmington, Del.

[21] Appl. No.: 292,594

[22] Filed: Aug. 18, 1994

[51] Int. Cl.[6] ..... B65H 18/16

[52] U.S. Cl. ..... 242/541.1; 242/541.7; 242/542.3

[58] Field of Search ..... 242/542.3, 541.1, 242/541.4, 541.7

[56] References Cited

U.S. PATENT DOCUMENTS

| | | | |
|---|---|---|---|
| 1,951,715 | 3/1934 | Valentine et al. . | |
| 3,116,031 | 12/1963 | Moore et al. . | |
| 3,743,199 | 7/1973 | Karr et al. . | |
| 4,179,330 | 12/1979 | Page . | |
| 4,905,925 | 3/1990 | Kremar . | |
| 4,934,619 | 6/1990 | Snygg . | |
| 4,979,689 | 12/1990 | Snygg . | |
| 5,026,005 | 6/1991 | Ehrola . | |
| 5,106,029 | 4/1992 | Ehrola . | |
| 5,184,787 | 2/1993 | Holzinger et al. . | |
| 5,240,198 | 8/1993 | Dörfel . | |
| 5,249,758 | 10/1993 | Müller et al. . | |
| 5,251,835 | 10/1993 | Kyytsönen . | |
| 5,370,327 | 12/1994 | Adamski | 242/533 |
| 5,375,790 | 12/1994 | Svanqvist | 242/541.1 |
| 5,393,008 | 2/1995 | Kyytsonen et al. | 242/542.3 |
| 5,405,099 | 4/1995 | Hehner et al. | 242/542.3 |

FOREIGN PATENT DOCUMENTS

| | | |
|---|---|---|
| 0483092 | 4/1992 | European Pat. Off. . |
| 0483093 | 4/1992 | European Pat. Off. . |
| 0395893 | 3/1994 | European Pat. Off. . |
| 1560039 | 8/1964 | Germany . |
| 4007329 | 9/1991 | Germany . |
| 4401804 | 1/1994 | Germany . |
| 379585 | 12/1931 | United Kingdom . |
| 2012733 | 8/1979 | United Kingdom . |
| 9306034 | 4/1993 | WIPO . |
| 9306033 | 4/1993 | WIPO . |

*Primary Examiner*—John M. Jillions
*Attorney, Agent, or Firm*—Dirk J. Veneman; Raymond W. Campbell; Gerald A. Mathews

[57] ABSTRACT

A method and apparatus for reeling a traveling web, such as the paper web produced on a papermaking machine, comprises the concept of winding the on-coming traveling web onto a reel spool which is horizontally supported rotatively, and which, in a preferred embodiment, moves translationally in a direction from the dry end of the papermaking machine towards the wet end of the papermaking machine as the diameter of the wound web roll increases. The reel spool is supported on a pair of spaced, substantially horizontally disposed rails. The on-coming web is first partially wrapped over a segment of a translationally movable support drum with the upper side of the web facing inwardly toward the surface of the support drum. The support drum is selectively nipped, or not nipped, with the reel spool/web over the web roll as it is commenced to be wound in a winding position, and continues to be wound into a web roll on a reel spool. As the web roll being wound increases in diameter, it is translationally moved upstream while being supported on the substantially horizontally disposed rails, and while torque is maintained on the reel spool.

7 Claims, 6 Drawing Sheets

METHOD AND APPARATUS FOR REELING A TRAVELING WEB INTO A WOUND WEB ROLL

CROSS-REFERENCE TO RELATED APPLICATION

This application relates to allowed, commonly assigned, U.S. patent application Ser. No. 08/060,171 filed May 6, 1993, now U.S. Pat. No. 5,370,327 the subject matter of which is incorporated herein by reference.

BACKGROUND OF THE INVENTION

1. Field of the Invention

This invention relates to the reeling of a wound web roll. More particularly, this invention relates to an improved method and apparatus for reeling a wound web roll which is maintained under torsion, and preferably nip pressure, and web tension substantially at all times during its formation. Still more particularly, this invention relates to an improved reel on a papermaking machine, and an improved method of reeling paper onto a reel spool, wherein, in a preferred embodiment, the paper is reeled into a wound web roll with its upper side, as produced on the papermaking machine, facing outwardly as it is wound into the wound web roll, and wherein the reel spool is continuously supported on a pair of spaced, horizontally disposed rails during the reeling process while a support drum can selectively nip, and partially support from below, the paper web roll being wound, by substantially vertical translational movement of the support drum.

2. Description of the Prior Art

Only recently has the reel on a papermaking machine changed conceptually from the prior-art type of reel as exemplified by the so-called Pope reel shown and described in U.S. Pat. No. 3,743,199. Besides the above-referenced, commonly assigned, U.S. patent application, other more recent reel designs are shown and described in U.S. Pat. No. 5,249,758; European Patent 0 395 893 B1, and European Patent applications 0 483 093 A1 and 0 483 092 A1.

In older reel designs, the reel spool was transferred from primary to secondary arms, and the nip of the reel spool onto a support drum was not accomplished smoothly or uniformly, or maintained with uniform or controlled nip pressure. Further, torque was typically not applied to the reel spool, on which the traveling paper web was being wound, but, when torque was applied, it was generally applied after the wound paper roll was transferred onto the secondary arms.

In the more recent reel designs, torque has been applied to the reel spool during most, or all, of its path of travel from the time it is loaded into the apparatus until the time the paper web roll has been completed. In addition, the translational path of reel spool travel has been made smoother and less convoluted. However, none of the prior-art reel designs provide a complete combination of torque, nip and tension over a wide range of operating parameters.

SUMMARY OF THE INVENTION

The deficiencies and design limitations of such prior art reel methods and apparatus have been obviated by this invention. In this invention, the reel spools, whether empty or completely wound into a paper web roll, are rotatively supported by bearings at each end of the reel spool, which bearings, in turn, are supported in rolling engagement by a pair of laterally spaced, substantially horizontally disposed rails. These rails are mounted in a frame which also serves to mount two pairs of movable, preferably pivoted, beams, with one beam of each pair of beams disposed on either side of the reel apparatus. Both pairs of beams are mounted above the support rails, and each of the pairs of beams operate independently of the other pair of beams about their pivot mountings.

All of the beams are mounted above the reel spool bearings such that the two beams on each side of the apparatus (i.e., one beam from each pair of beams) are disposed near an end of the reel spool in operating position, and are also disposed above one of the support rails which support the reel spool bearings.

A carriage is mounted to each beam in a manner to allow it to travel longitudinally for a substantial distance along the length of the beam. The two carriages on each pair of beams are thus adapted to engage an empty reel spool at the reel spool storage end of the reel apparatus and, in a preferred embodiment, transfer the reel spool longitudinally in a direction from the so-called dry end of the papermaking machine to the so-called wet end of the papermaking machine.

The traveling paper web which is produced at the dry end of the papermaking machine is passed over a segment of the peripheral surface of a support drum which is mounted on a frame so as to be disposed beneath the support rails. The support drum is mounted to move translationally upwardly and downwardly, whether vertically up and down, at an angle to the vertical along a straight path, or pivotally along an arc, so as to move translationally to engage a reel spool along a nip line of contact. Since the beams are mounted above the reel spool bearings on the support rails, the carriages for engaging and moving, and bearing housings rotatively supporting, the reel spools are also above the rails and reel spool bearings. This permits the support drum to be made smaller in diameter, and consequently lighter, so as to be capable of being moved into, and out of, nipping engagement with the web being wound into a roll on the reel spool relatively easily and quickly by lifting devices, such as pneumatic or hydraulic cylinders, or ball-screw actuators, or the like. Further, the relatively light construction and weight of the smaller diameter support drum permits any nip loading between the support drum and the paper web roll being wound to be controlled more accurately and in smaller increments.

In addition, since the upper side of the on-coming traveling paper web is wound on the outer side of the wound paper web roll, any pressure sensitive coating on the paper web is not scuffed at its interface with the relatively stable last ply of the paper web wound on the roll.

Some paper mills prefer to have their coated paper, whether the coating is pressure sensitive or not, applied to the upper side of the paper web as it is produced on the papermaking machine. This upper side is then desired to be wound on the reel with the coated side facing out for subsequent processing, such as being printed. The method and apparatus of this invention provide such a finished wound paper web roll with controlled internal wound web tension.

Accordingly, a feature of this invention is the provision of at least one pivoted pair of beams for supporting a corresponding pair of carriages for moving the reel spool translationally along a pair of reel support rails during the winding process, which pair of beams is mounted above the support rails and reel spool bearings.

Another feature and advantage of this invention is the ability to wind the paper web onto the reel spool from start to finish while the reel spool is maintained in a substantially horizontal path of travel.

Still another feature and advantage of this invention is the ability to utilize a relatively small diameter support drum in conjunction with the engagement of the support drum with a relatively small diameter reel spool along a nip line of contact therebetween while the reel spool is supported on a pair of spaced, horizontally disposed rails.

These, and other features, advantages and objectives, will be readily discerned by those skilled in the art upon reading the disclosure, particularly the description of the preferred embodiment, in conjunction with the accompanying drawings.

DESCRIPTION OF THE PREFERRED EMBODIMENT

Figure 1:
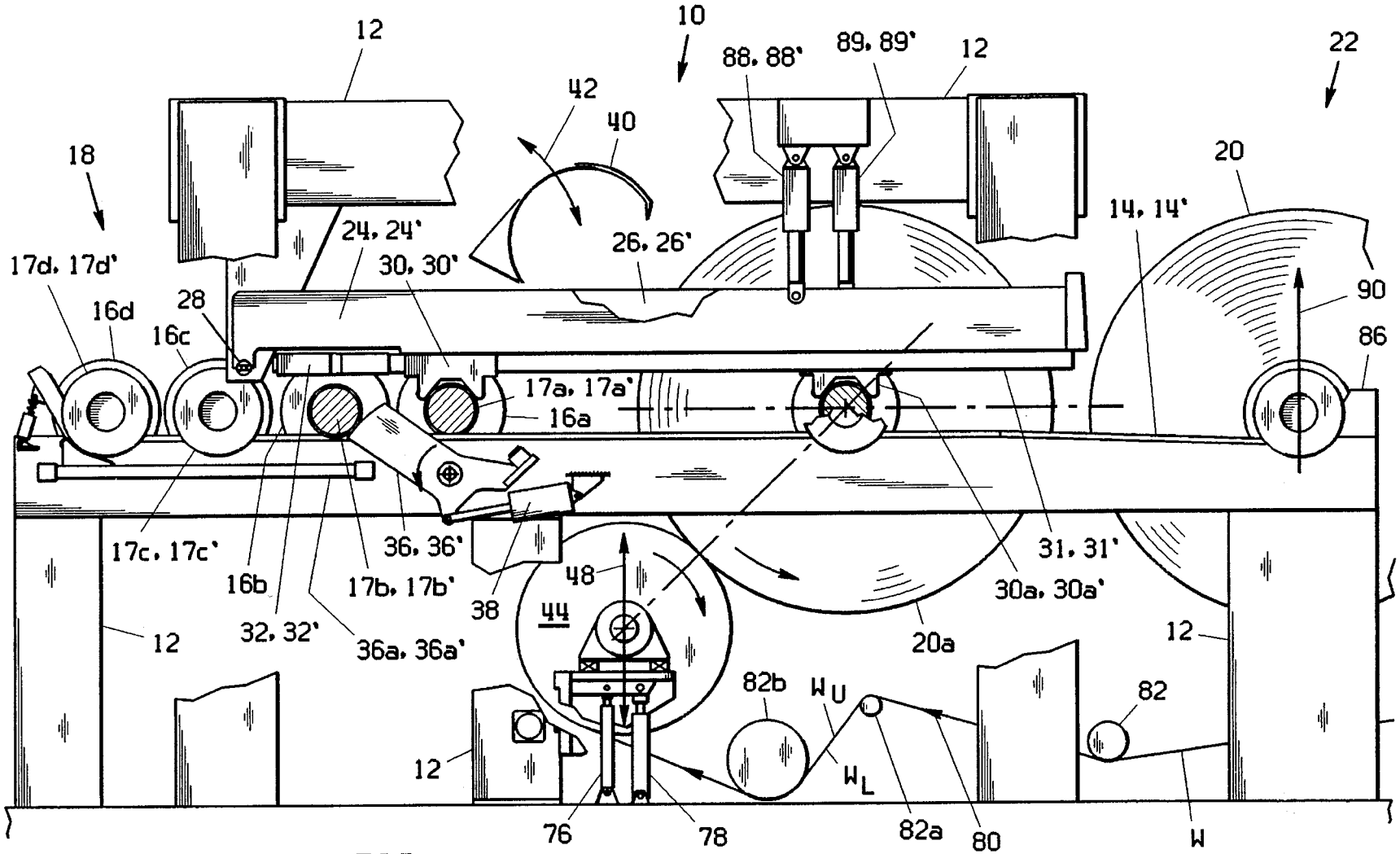
FIG. 1 is a side-elevational view of this invention, in somewhat schematic form, showing the horizontally disposed support for the reel spool and the reeling process in conjunction with the support drum and traveling paper web.

Referring to FIG. 1, the reel apparatus, generally designated with the numeral 10, includes a frame 12 on which are mounted a pair of spaced, horizontally disposed rails 14,14' for supporting reel spools **16*a*,16*b*,16*c*,16*d* from a spool storage area, generally designated with the numeral 18, at one end of the apparatus, to a finished wound paper web roll 20 at the other end of the reel apparatus, generally designated with the number 22**, where the wound web roll is stored for removal.

The reel apparatus of this invention generally comprises components which are structurally similar at both ends, such as in the case of a reel spool, or on both sides of the apparatus, such as in the case of the frame work, including the rails and support beams, which will be discussed later. There are some obvious, possible exceptions, such as the drives for the reel spool being wound and the support drum, which also will be discussed later, but such exceptions will either be specifically recited, or will be clear in the context of the overall disclosure. Accordingly, only one side of the apparatus will generally be shown and discussed, with the understanding that the other side of the apparatus will comprise essentially the same structure and operational arrangement. The prime mark will be used to distinguish between different ends, or sides, of a component, such as each end of a single reel spool, and alphabetical subscripts will be used to distinguish corresponding like elements, such as reel spools.

Also mounted to the frame 12 are two pairs of support beams 24,24' and 26,26'. One beam from each pair of beams is pivoted to the frame, such as at pivot 28 in FIG. 1, near the reel spool storage end, or downstream end of the reel on each side of the apparatus. Mounted to each beam of each pair of beams 24,24', 26,26' is a carriage 30,30' and **30*a*,30*a'* which is so constructed and arranged as to move along on ball screws, linear bearing slots, flanges, or the like, in the beam, and generally designated with the numeral 31,31'**, on rollers, or lubricated ways, or the like, on the carriages. One carriage on either side of the apparatus is arranged to cooperate with another carriage on the other side of the apparatus, with each carriage mounted on a beam of a corresponding pair of beams, so that they can engage a reel spool for translational movement in the direction longitudinally along the support beams. The reel spool is actually rotatively supported on the support rails in bearing housings which roll on the support rails.

On the pivoted end of each beam is an actuator, such as a pneumatic or hydraulic cylinders 32,32',33,33' (FIG. 8), but which might also comprise a ball screw or a chain and a driven sprocket arrangement, which has its extendible end connected to the carriage mounted on its support beam and the fixed end attached to the support beam. While the support beams on either side of the apparatus extend parallel to one another, and are spaced above the corresponding rail on each side of the apparatus, and coextend in the same direction with the rail on each side of the apparatus, such support beams on each side of the apparatus are spaced laterally from each other a distance sufficient to permit the carriage on each support beam on either side of the apparatus to bypass the other carriage on the other support beam on the same side of the apparatus. This permits the carriages **30*a*,30*a'* associated with a paper web roll being wound, such as shown at 20*a* in FIG. 1, to be retracted back into an initial position 34 (FIG. 3) where they can engage an empty reel spool, which initial position is further downstream than the carriages 30,30'** on the other support beam on the same corresponding sides of the apparatus, which are engaging the end of a new reel spool on which a fresh paper roll is about to be commenced to be wound.

Figure 10:
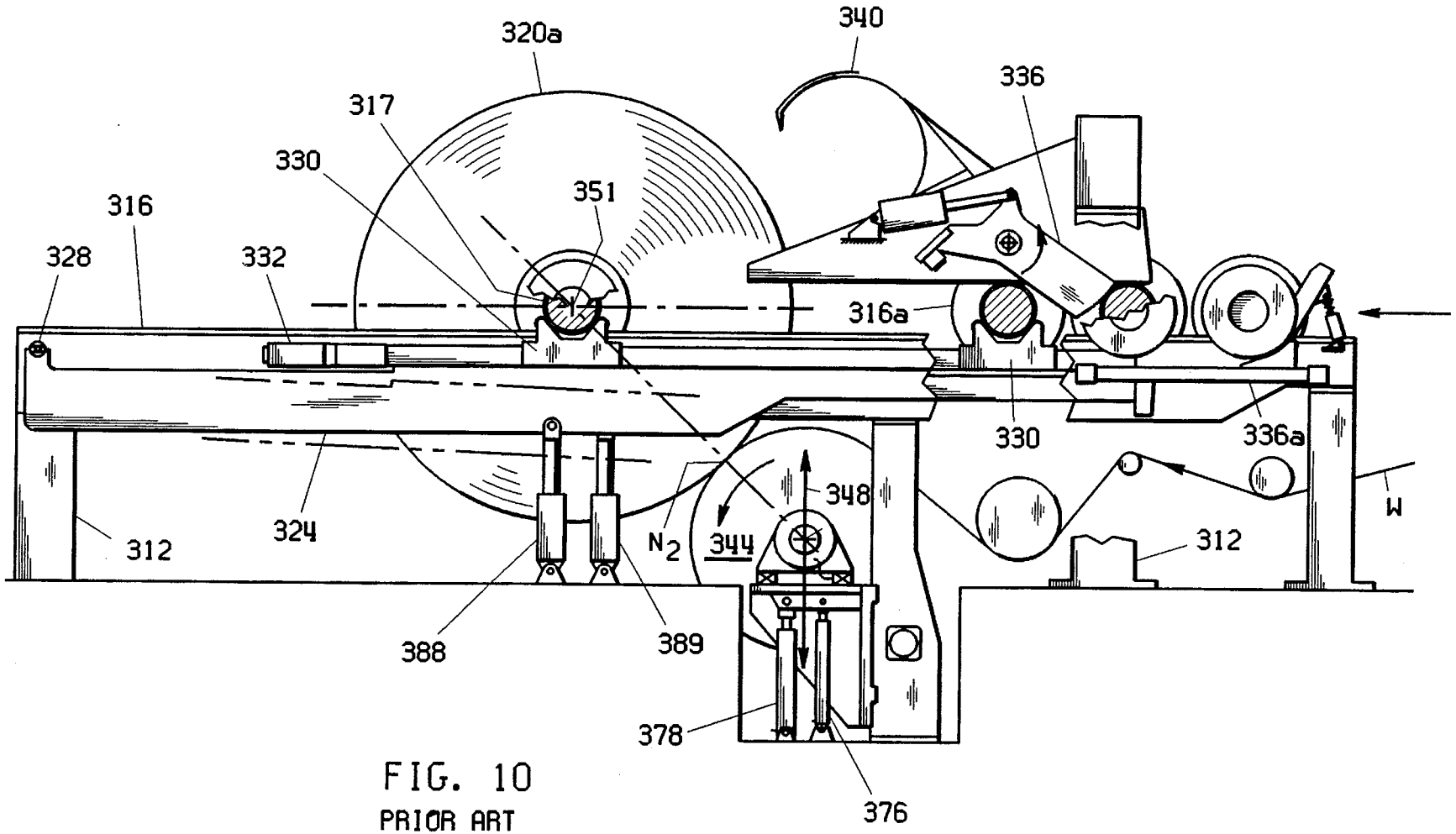
FIG. 10 PRIOR ART
FIG. 10 is a side elevational view of the prior-art reel shown, described and claimed in U.S. patent application Ser. No. 08/060,171, filed May 6, 1993.

The apparatus and operation of the support beams and their associated carriages is similar to that shown and described in U.S. patent application Ser. No. 08/060,171, filed May 6, 1993, now U.S. Pat. No. 5,370,327 which is also shown in FIG. 10, and, to the extent necessary to describe additional structure and operation of such support beams and their carriages as may be desired, the material from this patent application is incorporated herein by reference.

The carriages in this invention are mounted beneath the support beams, and are mounted to travel longitudinally along the bottom sides thereof, to engage the reel spools, which are rotatively mounted in bearing housings which, in turn, are adapted to roll along rails 14,14' for applying force to the reel spools, preferably through their bearing housings, to either nip them with the support drum, to be described later, or to move the reel spools and the web roll being wound thereon along the rails, or to maintain tension in the web between the support drum and the paper web roll being wound on the reel spool, or any combination of these operations.

Rails 14,14' are spaced apart, parallel and extend linearly horizontally from a spool storage end 18 to a finished wound paper web roll end 22. Preferably, rails 14,14' extend horizontally linearly in a continuous line throughout their operational length.

FIG. 1 also shows spool stop apparatus, generally designated with the numerals **36,36*a*, for both maintaining empty spools in a ready position in the reel spool storage area, and for releasing a single spool at a time to be released and positioned into an initial position 34 (FIG. 3) by actuation of a fluid cylinder 38. Such apparatus for holding empty reel spools and releasing them one at a time is known in the industry and will not be discussed further. Also, FIG. 1 illustrates a so-called web turn-up apparatus 40 which pivots in the direction of double-headed arrow 42 into, and out of, a position where it is disposed about a portion of the periphery of an empty reel spool in the initial position 34 for intercepting and guiding the on-coming severed end of the paper web about the reel spool to wrap the reel spool to commence winding the web on it. Such turn-up devices often utilize a plurality of compressed air streams to direct the on-coming paper web into wrapping engagement with the reel spool. The position of the turn-up apparatus during the web turn-up procedure is also shown in FIG. 3**.

Figure 3:
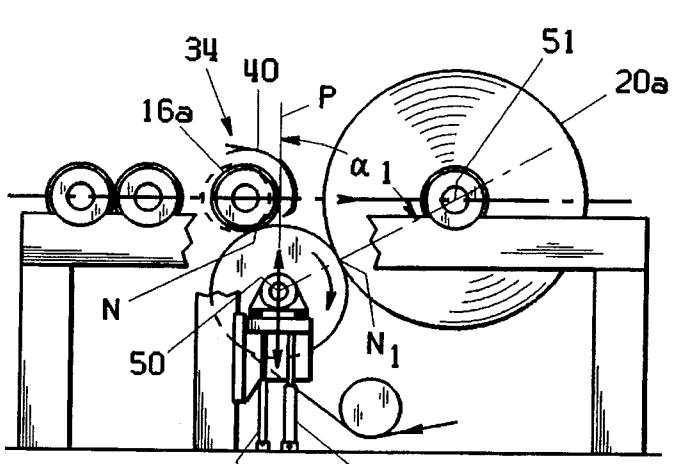
FIGS. 2–5 are side-elevational views showing a web roll being finished (FIG. 2), a new web roll being started as the previous wound roll is finished (FIG. 3), the newly started roll being passed over the support drum as it is passed to the winding position (FIG. 4), a web roll in the winding position (FIG. 5).
Figure 2:
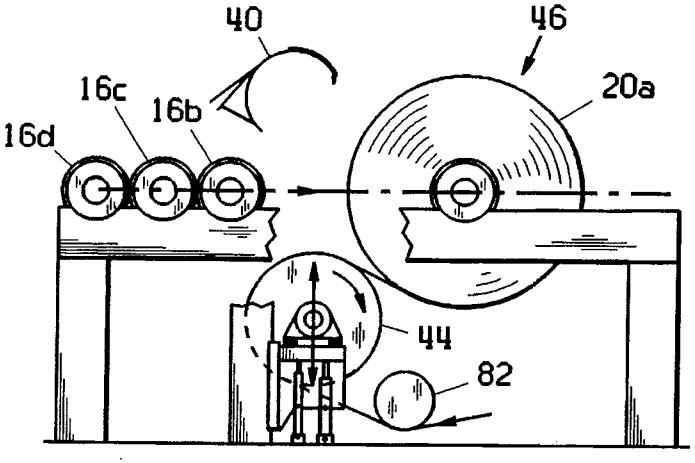

FIGS. 2–5 illustrate the sequence of a wound paper web roll **20*a* nearing its completion, as shown in FIG. 2, while, in FIG. 3, the paper roll being wound has been finished and a new reel spool 16*a* is shown in the initial position where the severed web is initially wrapped onto the new reel spool. In FIG. 2, the paper web roll being wound is shown in its alternate winding position 46 where it is not nipped with support drum 44, but is turned solely by a centerwind drive, to be described later. In FIG. 3**, the paper web roll being wound is driven by a combination of a centerwind drive and the nipping engagement of the support drum and the paper web roll.

In the initial position 34, which extends for a short distance or span along the support rails from slightly out of nipping engagement with the support drum, in the direction of empty reel spool storage, to nipping engagement N with the support drum, the empty reel spool can either be not in nipping engagement with the support drum, or in nipping engagement N with the support drum, as shown in FIG. 3.

Figure 4:
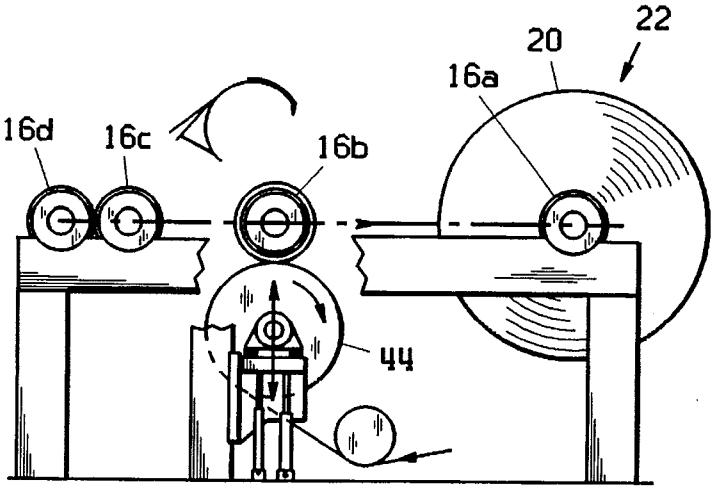

In FIG. 4, the finished wound web roll 20 has been moved downstream to the wound web roll storage area 22 while the newly-started reel spool **16*b* has been moved by its carriages, not shown in this figure, along its horizontal path while being supported on the rails through its bearing housings and over the top of the peripheral surface of the support drum 44**.

Figure 5:
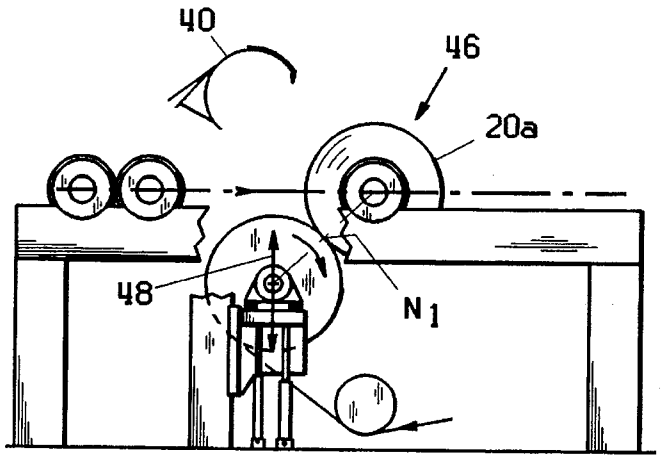

In FIG. 5, the web roll **20*a* being wound has been moved translationally to the winding position 46 where, in one preferred embodiment, it is maintained in nipping engagement with the support drum which is moved substantially vertically in the direction of double-headed arrow 48 to maintain the desired nip pressure $N_1$, or its position $\alpha_1$, such as shown in FIG. 3, or both. The angular position $\alpha_1$ is the angle from a vertical plane P through the rotational axis 50 of the support drum to a plane having both axis 50 and the rotational axis 51 of the paper web roll 20*a*** being wound.

Figure 6:
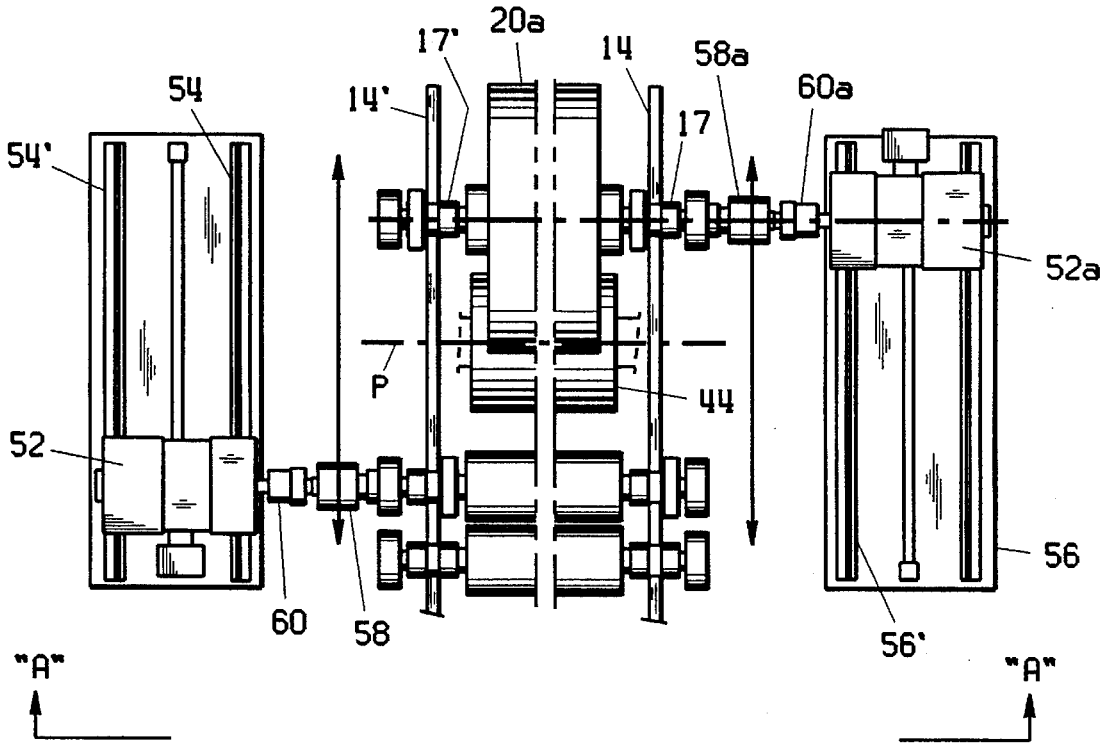
FIG. 6 is a plan view, in somewhat schematic form, showing the manner in which successive reel spools can be driven alternately from either end.
Figure 7:
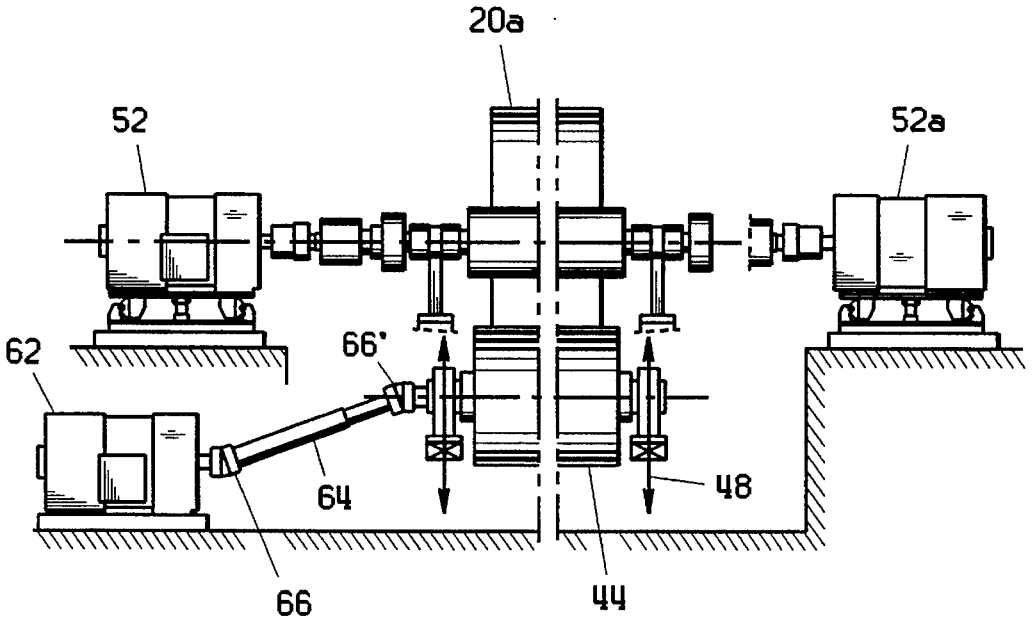
FIG. 7 is an end elevational view of a drive arrangement at one end of a reel spool along section A—A in FIG. 6, and also showing the drive arrangement for rotating the support drum.

FIGS. 6 and 7 illustrate drive apparatus for rotatively driving both the reel spools and the support drum to control both their absolute speeds and any desired speed differential between the reel spool on which the paper web roll is being wound and the support drum in order to provide the desired web tension being wound into the wound web roll. As shown in FIG. 6, the reel spools can be driven by applying torque from separate motors **52,52*a* mounted on rails 54,54' and 56,56' which co-extend with the rails 14,14' on which the reel spools are rotatively supported in their bearing housings 17,17' which roll on the rails. By mounting the reel spool drive motors on either side of the apparatus to travel parallel with the reel spools during their movement on their support rails, alternate reel spools can be engaged by extendable/retractable couplings 58,58*a* attached to the drive shafts 60,60*a* of the respective motors in a manner such that an empty reel spool can be brought into its initial position and rotatively brought up to speed by one drive motor, while the drive motor on the other side of the apparatus can be completing the winding of a web roll and continue to drive the wound web roll after it has left either nipping engagement with the support drum, or proximity with the support drum, and moved to its storage position on the support rails. With reference to FIG. 7, the support drum 44 can also be continuously driven by motor 62 through a splined shaft 64 which utilizes universal couplings 66,66'** to maintain continuous driving engagement of the support drum regardless of its vertical position in the apparatus.

The support drum may also be driven by a journal mounted gear box, or by belt drive.

The support drum is movable substantially vertically to engage the reel spool/wound web roll along a nip line of contact $N_1$ therebetween. Such vertical movement can be either absolutely vertical, linear along an angle to a vertical plane, or along an arc, such as if the support drum is mounted on a pair of arms to move through an arcuate path of travel. These alternatives are collectively considered to be substantially vertical.

The apparatus and operation of the means for rotatively driving the reel spools and support drum is similar to that shown and described in U.S. patent application Ser. No. 08/060,171, filed May 6, 1993, now U.S. Pat. No. 5,370,327 and, to the extent desired to learn of additional details of its structure and operation, its disclosure is incorporated herein by reference.

Figure 8:
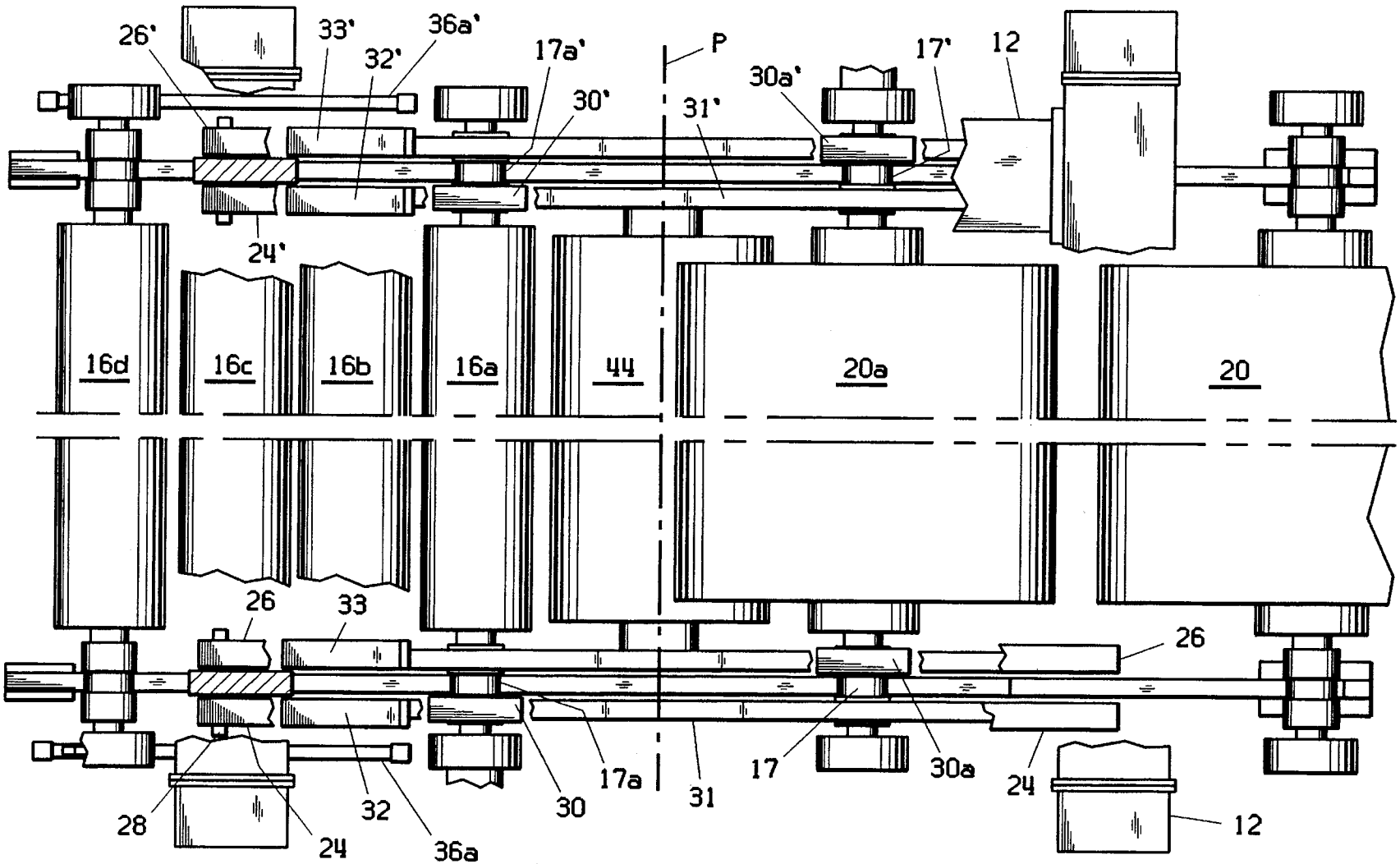
FIG. 8 is a plan view, in somewhat schematic form, showing the pivoted pairs of carriage beams for guiding the carriages during their cycle of operation.

FIG. 8 illustrates the preferred arrangement for mounting the carriages on two pairs of co-axially pivoted support beams 24,24' and 26,26' on which the carriages for guiding the bearing housings 17,17' and **17*a*,17*a'* of successive reel spools are mounted to roll, or otherwise move, longitudinally therealong and to bypass one another as the carriages which have moved a finished wound web roll to its storage position move past the carriages which are supporting a reel spool in its initial, or winding, positions to return to the supply of reel spools and receive an empty reel spool from the spool stop apparatus 36 (FIG. 1** ).

This support beam pivoting and guiding apparatus is also shown and described in more detail in U.S. patent application Ser. No. 08/060,171, and, to the extent desired to learn additional details of its structure or operation, its disclosure is incorporated herein by reference.

Figure 9:
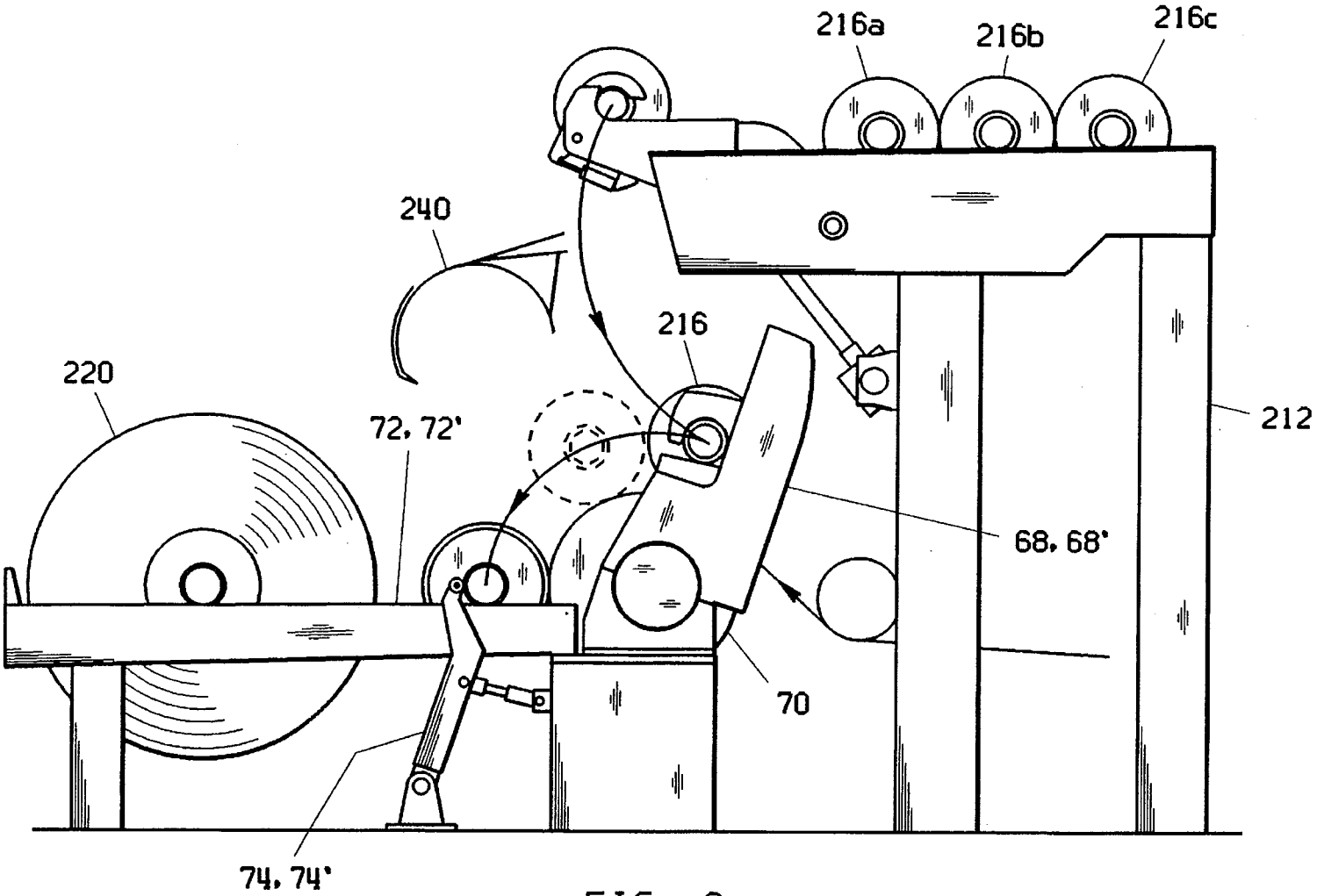
FIG. 9 ( PRIOR ART )
FIG. 9 is a side elevational view of a prior-art Pope-type reel.

In FIG. 9, a prior art Pope-type reeling apparatus is shown which utilizes a pair of primary arms 68,68' to initially receive a new reel spool and to bring it into nipping engagement with the support drum 70 after which the web is threaded into the nip to wrap the reel spool, and the reel spool on which the on-coming web is wound is moved downwardly over the surface of the support drum 70 in nipping engagement therewith, after which it is deposited on horizontal rails 72,72'. At this point, the secondary arms 74,74' engage the reel spool and hold it into a nipping engagement with the support drum as the wound web roll increases in diameter.

Other elements, such as the wound web roll and empty reel spools, which are common to any type of reel apparatus, are designated with corresponding numerals, but in a 200 series. Thus, the wound web roll in the Pope reel is designated 220.

FIG. 10 illustrates the reel apparatus which is shown, described and claimed in U.S. patent application Ser. No. 08/060,171, filed May 6, 1993, now U.S. Pat. No. 5,370,327. Corresponding elements have corresponding numerals, but in a 300 series. While the apparatus in this referenced patent application works well, it requires a support drum 344 which is relatively large in diameter in order to come into nipping engagement with the reel spool in the initial position due to the support of the reel spools by the carriages disposed beneath the reel spools. The weight of the support drum is commensurate with its relatively large diameter, and this requires the hydraulic cylinders 376,378 for providing macro and micro movement and adjustment, respectively, of the support drum into position to be quite large to the extent that such macro and micro movement and adjustment is difficult to effect and control, particularly with respect to fine tuning the nip $N_2$ at frequent intervals and in small increments, during operation.

In the operation of this invention, with particular reference to FIGS. 1–5, the on-coming web W traveling from the upstream direction of the so-called wet end of the papermaking machine towards the downstream direction of the so-called dry end of the papermaking machine, in the direction of arrow 80, and is directed over a plurality of guide rolls **82,82*a*,82*b* onto the support drum such that its upper side $W_u$ comes into supporting contact with a segment of the peripheral surface of the support drum and is, in turn, wrapped onto an empty reel spool 16*a* by action of the turn-up apparatus 40, which has been moved downwardly (FIG. 3) to a position of spaced adjacency with the spool 16*a* to initiate the wrapping of the on-coming web onto the reel spool. The web turn-up apparatus 40 initiates the turn-up only after the new reel spool is brought from the storage position to the initial position and nipped N with the support drum. At this location, the reel spool is also being torqued by a motor 52,52*a***. When the web is wrapped onto the web roll being wound, in the preferred embodiment, the upper side $W_u$ is facing outwardly, and the lower side $W_L$ is wrapped facing inwardly.

The new, empty reel spool had previously been moved into its initial position 34 from the reel spool storage area 18 of the apparatus which contains a supply of reel spools **16*b*,16*c*,16*d***.

In its initial position, which is spaced slightly downstream from nipping engagement with the support drum 44, the empty reel spool **16*a* is engaged by the carriages 30,30' which are slidably mounted on the bottom of a pair of support beams 24,24' which are pivoted at 28 downstream of the apparatus. Reel spool 16*a*, like the other reel spools, is rotatively mounted in a corresponding pair of rotatable bearing housings 17*a*,17*a'* which rotatively support the reel spools for translational movement along the support rails 14, 14'. Carriages 30,30' are acted upon for reciprocal movement along their support beams by actuation of power cylinders 32,32' to move longitudinally along their support beams in a direction substantially parallel with the rails supporting the reel spools. In this manner, the reel spools are rotatively supported on the rails 14, 14'**, but are moved by the carriages which are mounted on the pivoted support beams. Since engagement of the reel spool bearing housings by the carriages need only be to the extent necessary to reciprocate them while they are supported on the rails, the support beams need not be exactly parallel with the support rails in operation.

The reel spool **16*a* is engaged by one of the differential drive motors through its coupling on one end of the reel spool on either the front or the back side of the reel apparatus. The reel spool is thereby brought up to speed in the initial position to commence winding the on-coming web onto the reel spool with a desired amount of tension as provided by the reel spool drive motor 52 or 52*a* which may operate in conjunction with a differential speed between it and the motor 62 rotatively driving the support drum 44**. The newly started reel spool can optionally be either brought into nipping engagement $N_1$ with the support drum, or remain slightly spaced from the support drum. In either position, the torque applied to the reel spool, operating in conjunction with the torque applied to the support drum, and, if applicable, the nip $N_1$ between the web building into a roll on the reel spool and the support drum, operate to build a desired amount of web tension into the web roll being wound.

At some point in the web roll winding process after the initial layers of the web have been wound onto the newly started reel spool, the carriages 30,30' move the web roll into a winding position, generally designated with the numeral 46, which is upstream of the apparatus in a direction against the direction of the on-coming paper web. In this winding position 46, which is shown in spaced adjacency with the support drum in FIG. 2, and which is shown in nipping engagement $N_1$ with the support drum in FIG. 5, the web roll is wound to its finished diameter.

In moving from the initial position to the winding position, if it is desired to maintain nipping engagement with the newly started paper web roll, the support drum 44 is moved up and/or down in the direction of double-headed arrow 48 to provide the desired amount of nip $N_1$, and maintain the nip, with the web roll being wound, regardless of the increasing diameter of the web roll being wound, as the carriages move the reel spool, and the web roll being wound thereon, horizontally along the linearly extending horizontal path of the support rails from the initial position to the winding position by the rolling motion of the bearing housings 17,17' supporting the reel spool on the support rails 14,14'.

The actuation cylinders 32,32'; 33,33' can also assist in maintaining or adjusting the nip between the web roll being wound and the support drum. This can be done by controlling the positions of the carriages on the support rails.

When a wound paper roll has been finished and transported to a storage area 22 at one end of the apparatus, and where the support rails 14,14' might angle downwardly slightly to maintain the wound roll against a stop 86 at the end of the reel apparatus, the support beams 24,24' on which the carriages 30,30' which had previously translationally moved the web roll being wound along its horizontal path of travel on the support rails, is lifted by actuation of power cylinders 88,88', at which point actuation cylinders 32,32' retract and move the carriages 30,30' downstream back to a position where they can receive a new, empty reel spool in the initial position. During this time, the actuation cylinders 33,33' on the other pair of pivoted support beams 26,26' are actuated to move their pair of carriages **30*a*,30*a'* to move a new/empty reel spool first into initial position and then through the cycle of winding position with optional nipping engagement with the support drum, and then into storage position from which it is removed from the apparatus as shown by arrow 90**.

In a manner similar to the pivoted operation of the other pair of support beams 24,24', when the paper web roll has been wound to its desired finished diameter, a pair of hydraulic cylinders 89,89' are actuated to lift the pivoted support beams 26,26' about their pivot 28 to lift carriages 30*a*,30*a'* from engagement with the bearing housings 17,17' to permit the wound web roll to be moved to the storage area for removal.

The alternate pivoting of the two pairs of support beams, in conjunction with their lateral spacing on either side of the reel apparatus, permits their respective pairs of carriages 30,30'; 30*a*,30*a'* to be reciprocated past one another as they are moved longitudinally along the lower sides of the support beams. Therefore, when the reel apparatus is operating, it can handle both a reel spool on which a wound paper web roll is near being finished and a newly started web roll simultaneously.

By supporting the carriages beneath pivotally mounted beams which are located above the support rails, on which the bearing housings of the reels are supported for rolling movement horizontally from at least the initial position to the winding position where the paper web roll is finished being wound, the support drum 44 can be brought into nipping engagement with the reel spool, and the paper web being wrapped on the reel spool, when the diameter of the support drum is quite small. This is because the carriages which move the reel spools translationally, laterally in their horizontal path of travel on the support rails 14,14' are positioned above the bearing housings (i.e. reel spool bearings) which rotatively support the reel spools on the support rails. The relatively small diameter of the support drum permits it to be moved relatively more easily, more quickly and in smaller, more controlled increments of nip load between the support drum and the paper web roll being wound. This permits the winding of pressure-sensitive papers, such as carbonless copy paper and other coated or fine papers.

It is contemplated that variations can be made in the apparatus and operation without departing from the spirit or scope of the invention. For example, while the support beams are described as preferably being pivoted, they could be mounted to move translationally upwardly and downwardly relative to the rails.

Similarly, while the invention has been described in the preferred embodiment as configured so as to advantageously wind the web with the upper side facing outwardly on the wound web roll, it is contemplated to wind the web with its upper side facing inwardly on the wound web roll. This would be done, with reference to FIG. 1, by passing the web around the other side of the support drum, reversing the support drum direction, and passing the web through the nip $N_1$. In such a case, movement of the empty (new) reel spool from the initial position to the winding position would be in the direction of the web traveling from the wet end to the dry end of the papermaking machine.

What is claimed is:

1. A method of reeling a traveling web having upper and lower sides into a wound web roll, comprising the steps:

1) moving a reel spool having a rotational axis to an initial position where it is rotatively supported;

2) bringing the traveling web into supported engagement with a segment of the peripheral surface of a translationally movable, rotatively driven support drum, with the said upper side of the web facing inwardly toward the support drum surface;

3) applying torque to the reel spool to rotate and drive the reel spool to maintain tension in the web between the reel spool and support drum;

4) bringing the traveling web into wrapping engagement with the reel spool with the upper side of the web facing outwardly as it is commenced to be wound into a wound web roll thereon;

5) moving the web roll being wound translationally substantially horizontally from the initial position to a winding position, the winding position being upstream relative to the support drum, while maintaining it rotatively supported;

6) maintaining torque on the reel spool until the wound web roll reaches a predetermined diameter.

2. A method of reeling a traveling web into a wound web roll, as set forth in claim 1, further including the step, between steps 4) and 5) of claim 1, of:

selectively engaging the web over the reel spool with the support drum along a nip line of contact therewith in the initial position, or maintaining the driven support drum disengaged from nipping engagement with a reel spool, as desired, to provide a predetermined amount of tension in the wound-in web in the wound web roll.

3. A method of reeling a traveling web into a wound web roll, as set forth in claim 1, wherein:

the initial position is downstream relative to the support drum; and further including the step of:

maintaining the wound web roll in nipping engagement with the support drum as it is moved from the initial position to the winding position.

4. Apparatus for reeling a traveling web having upper and lower sides into a wound web roll onto a reel spool, comprising, in combination:

a frame;

support means for engaging the web roll along a nip line of contact during the reeling process;

rail means, including a pair of laterally spaced, substantially horizontally disposed rails, mounted on the frame for supporting a reel spool in an initial position, and for supporting the reel spool for linear movement substantially horizontally from the initial position upstream, relative to the support means and the direction of web travel, to a downstream winding position relative to the support means and the direction of web travel;

carriage means, including a carriage disposed on each side of the apparatus, for engaging either end of a reel spool in the initial position, and for linear movement of the reel spool substantially horizontally along the rail means to move the reel spool translationally from the initial position to the winding position;

support beam means, including at least two support beams arranged as a pair of support beams with one such beam disposed on either side of the apparatus near a corresponding rail, each beam pivotally mounted on the frame above the rail means, each support beam for supporting a carriage spaced above its corresponding rail, for translational movement longitudinally of the carriages along the beam, and for moving the reel spool with the carriages in a controlled manner along the rail means;

drive means for applying torque to the reel spool to rotatively drive the reel spool in its initial position, during its horizontal translational movement from its initial position to the winding position, and while it is in the winding position;

web turn-up means mounted on the frame for bringing the severed end of a traveling web onto the reel spool to be wrapped thereon in its initial position to commence winding the traveling web into a wound web roll thereon;

the support means includes a translationally, substantially vertically, movable support drum for receiving the traveling web with the lower side of the web facing outwardly from the support drum surface, and for directing the traveling web onto the reel spool in its initial position to be wound into a web roll with the upper side of the web facing outwardly on the wound web roll;

drive means operatively connected to the support drum for rotatively driving the support drum, the rotation of which provides at least a component in the force for maintaining tension in the web being wound into a roll.

5. Apparatus for reeling a traveling web having upper and lower sides into a wound web roll onto a reel spool, as set forth in claim 4, further including:

a second pair of support beams arranged as a pair of support beams with one such beam disposed on either side of the apparatus near a corresponding rail, each beam pivotally mounted on the frame whereby the said second pair of support beams are disposed above the rail means, each of said second support beams for supporting a second carriage spaced above its corresponding rail, for translational movement of the carriage longitudinally along the second support beam, and for engaging and moving the reel spool in a controlled manner along the rail means, the second pair of support beams mounted such that their pivotal movement, and the reciprocal movement of their carriages, do not interfere with the pivotal movement of the first pair of support beams, and the reciprocal movement of their carriages.

6. Apparatus for reeling a traveling web having upper and lower sides into a wound web roll onto a reel spool, as set forth in claim 4, wherein:

the support beam means is pivotally mounted on the frame downstream, in the direction of web travel, from the support drum such that movement of the carriages from the initial position to the winding position is in a direction upstream relative to the direction of web travel into the reeling apparatus.

7. Apparatus for reeling a traveling web having upper and lower sides into a wound web roll onto a reel spool, as set forth in claim 4, wherein:

the initial position is downstream relative to the support drum;

the winding position is upstream relative to the support drum.

* * * * *